US012697555B2

(12) United States Patent
Chen

(10) Patent No.: US 12,697,555 B2
(45) Date of Patent: Aug. 4, 2026

(54) INFLATABLE STRUCTURE WITH INTEGRATED CARRIER

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 326 days.

(21) Appl. No.: 18/409,635

(22) Filed: Jan. 10, 2024

(65) Prior Publication Data

US 2025/0222366 A1 Jul. 10, 2025

(51) Int. Cl.
*A63G 31/12* (2006.01)

(52) U.S. Cl.
CPC ..... *A63G 31/12* (2013.01)

(58) Field of Classification Search
CPC ..... A63G 31/12; A63G 21/18; A63G 31/00
See application file for complete search history.

(56) References Cited

U.S. PATENT DOCUMENTS 9,861,901 B1 * 1/2018 Pierzynski ..... E04H 15/20

* cited by examiner

*Primary Examiner* — Nathan J Flynn
(74) *Attorney, Agent, or Firm* — Clement Cheng

(57) ABSTRACT

An inflatable device has an inflatable structure. The inflatable structure has an inflated mode and a deflated mode. The inflatable structure has an inflatable base. The inflation module is connected to the inflatable structure. The inflation module has a fan blower powered by a fan motor. The inflation module further includes an air intake. The fan blower draws air from the air intake and inflates the inflatable structure. The inflation module forms a storage housing. The storage housing receives the inflatable structure when the inflatable structure is in a deflated mode.

20 Claims, 5 Drawing Sheets

INFLATABLE STRUCTURE WITH INTEGRATED CARRIER

The present invention has no foreign or domestic priority claim.

TECHNICAL FIELD

The present invention is in the field of inflatable play structures.

BACKGROUND

Current inflatable play structures have an electric fan that maintains inflation of the inflatable play structures. The inflatable play structures are temporary and often set up for children's events such as birthday parties and neighborhood parties. A variety of different references in the patent picture describe various inflatable play structures.

For example, in Lau U.S. Pat. No. 7,127,762, issued Oct. 31, 2006, entitled Inflatable Product with Stowable Pump, the inventor describes, "An inflatable product has a socket disposed in a wall of an inflatable body and extending into an interior of the inflatable body. A pump is slidably disposed in the socket, and is slidable from a retracted position to an extended position. The retracted position defines an insertion limit of the pump into the socket, and the extended position defines a withdrawal limit of the pump from the socket. The pump is operable to inflate the inflatable body when in the extended position. The pump includes a power source connected to a fan, operable to inflate the inflatable body. The pump includes a switch operable to activate the fan when in a closed position. The switch is in an the closed position when the pump is in the extended position, and in an open position when the pump is in the retracted position. The pump includes an air intake in fluid communication with ambient air when the pump is in the extended position, and the air intake is sealed from the ambient air when the pump is in the retracted position. The socket includes an outlet in fluid communication with an interior of the inflatable body, and, when the pump is in the extended position, the socket and the pump define a sealed conduit fluidly connecting an outlet of the pump to the outlet of the socket to inflate the body indirectly via the sealed conduit. The socket has an opening through which the pump extends and the opening is substantially sealed by the pump. The pump seals the outlet of the socket when the pump is in the retracted position. Detent projections and recesses releasably maintain the pump in the extended position. A battery is removable when the pump is in the extended position".

For example, in Amberg US Patent 2009/0124402 A1, issued May 14, 2009, entitled Inflatable Play Structure with Integrated Air Source, the inventor describes, "An inflatable structure having an integral air pump positioned within a housing at or near an edge of the structure. The housing is generally formed of the same material as the play structure. An orifice within the housing operably connects the air pump to the air chambers of the inflatable device. A flexible hose may be used to connect the air pump to the orifice. An access hatch is provided to facilitate air exchange and allow the air pump to be viewed during operation. This configuration increases safety because it eliminates the likelihood that users, generally children, will touch or come into contact with an externally positioned air pump during use".

For example, in Thompson US Patent 2015/0148141 A1, issued May 28, 2015, entitled Inflatable Play Structure with Integrated Inflation Mechanism, the inventor describes, "Embodiments of inflatable play structures are presented. In an embodiment, the inflatable play structure includes an air pump integrated with the inflatable play structure and configured to inflate the inflatable play structure to a pressure level, and to seal air at the pressure level into the inflatable play structure".

For example, in Lindstrom US Patent 2016/0310860 A1, issued Oct. 27, 2016, entitled Inflatable Play Structure, the inventor describes, "An inflatable structure having an integral air pump positioned within a housing at or near an edge of the structure. The housing is generally formed of the same material as the play structure. An orifice within the housing operably connects the air pump to the air chambers of the inflatable device. A flexible hose may be used to connect the air pump to the orifice. An access hatch is provided to facilitate air exchange and allow the air pump to be viewed during operation. This configuration increases safety because it eliminates the likelihood that users, generally children, will touch or come into contact with an externally positioned air pump during use".

SUMMARY OF THE INVENTION

An inflatable device has an inflatable structure. The inflatable structure has an inflated mode and a deflated mode. The inflatable structure has an inflatable base. The inflation module is connected to the inflatable structure. The inflation module has a fan blower powered by a fan motor. The inflation module further includes an air intake. The fan blower draws air from the air intake and inflates the inflatable structure. The inflation module forms a storage housing. The storage housing receives the inflatable structure when the inflatable structure is in a deflated mode.

Optionally, the inflatable carrier's fan blower is mounted at the air intake. The connection straps are mounted on the storage housing and are configured to connect the storage housing to the inflatable base. The inflatable carrier has an attached mode, where the inflation module attaches to the inflatable structure at the inflatable base. An air inlet conduit receives airflow from the fan blower which is configured to inflate the air inlet conduit. The air inlet conduit is inflatable. The inflation module has a detached mode. The inflation module detaches from the inflatable structure, only being connected at a conduit. The inflatable structure can be removed from the inflation module. The connection straps are configured to close the storage housing and retain the inflatable structure within the storage housing. The air collector is formed around the fan blower. The air collector is configured to muffle the sound of the fan motor.

The following call out list of elements can be a useful guide in referencing the element numbers of the drawings.

20 Inflatable Structure
21 Inflatable Base
22 Inflatable Column
23 Jumping Surface

24 Upper Canopy
25 Enclosure Panel
26 Stowed Package
27 Storage Sheath
28 Storage Housing
29 Connection Straps
30 Inflation Module
31 Inflation Module Housing
32 Fan Blower
33 Air Intake
34 Fan Motor
35 Air Inlet Conduit
36 Air Inlet Collector
37 Storage Housing Connector
41 Storage Opening Edge
42 Roll Configuration
43 Storage Proximal Portion
44 Conduit Connection
45 Carry Handle
46 Air Intake Grill
51 Electrical Cord
52 Pull Handle
53 Wheels
87 Air Inlet Collector Concave Cavity
88 Air Inlet Collector Cover
89 Motor Cover

DETAILED DESCRIPTION OF THE EMBODIMENTS

Figure 1:
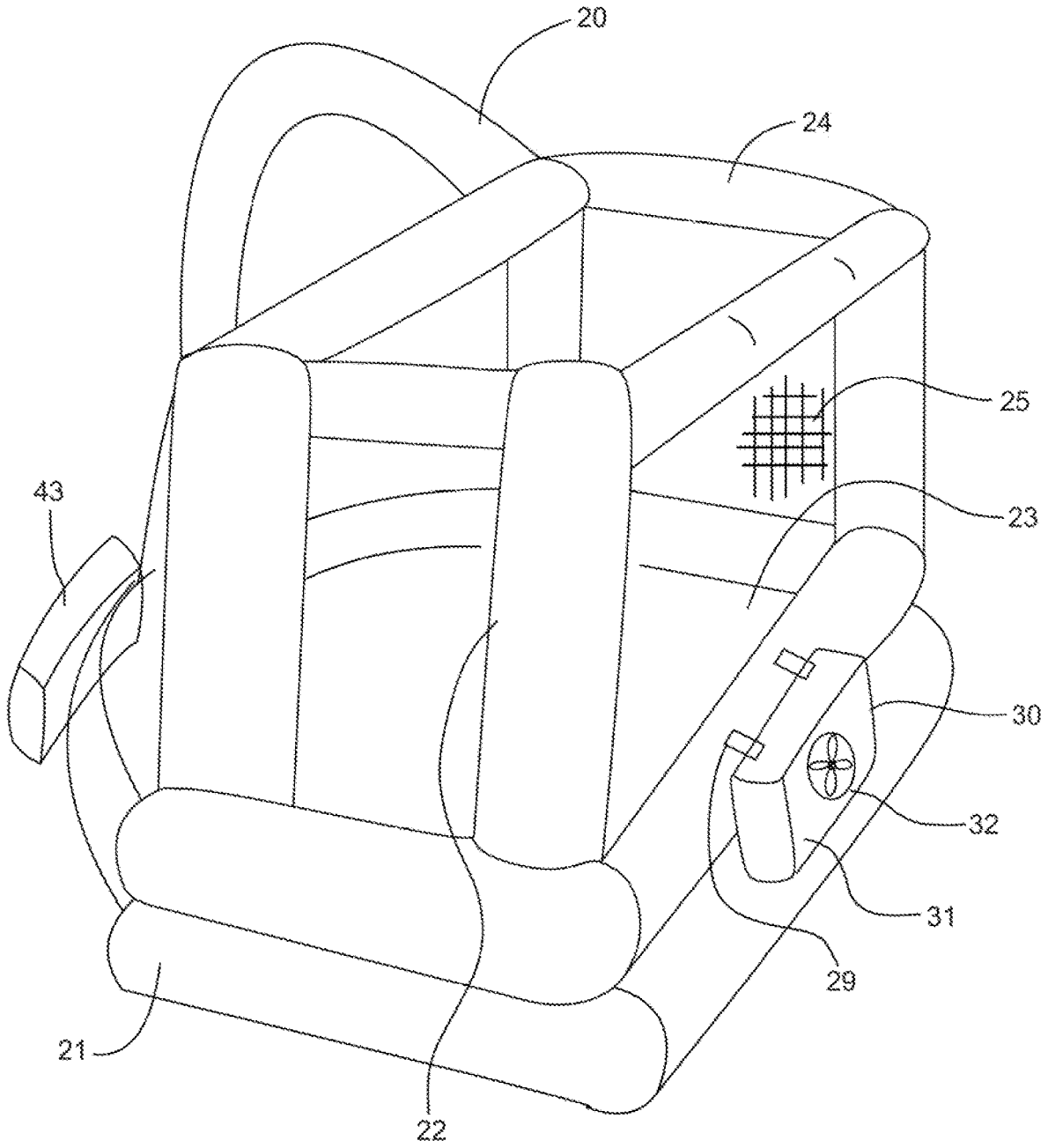
FIG. 1 is a deployed perspective view diagram of the present invention in the attached mode.

As shown in FIG. 1, an inflatable structure has an upper canopy 24 and closing a jumping surface 23. Vertical inflatable columns 22 support enclosure panels 25 extending between the inflatable columns 22. Additionally, an inflatable base 21 supports the inflatable column 22. The inflatable base 21 provides a jumping surface 23. The inflatable structure 20 has communicating fluid through it such that an air flow from the inflatable base 21 can flow through the inflatable column 22 and the jumping surface 23. The enclosure panel 25 can be bounded between the upper canopy 24, the inflatable base 21, and a pair of inflatable columns 22. The foreclosure panel 25 can be formed of a netting for retaining the users within the jumping surface 23.

An inflation module 30 can be mounted to the inflatable base 21 in an attached mode where straps 29 can strap connect the inflation module 30 to the inflatable base 21. The inflation module 30 is electrically powered such as by household electric current. The inflation module 30 has a fan blower 32 mounted in an inflation module housing 31. The inflation module housing 31 can be flexible and have a soft padded outside surface such as a foam or inflatable outside surface.

Figure 2:
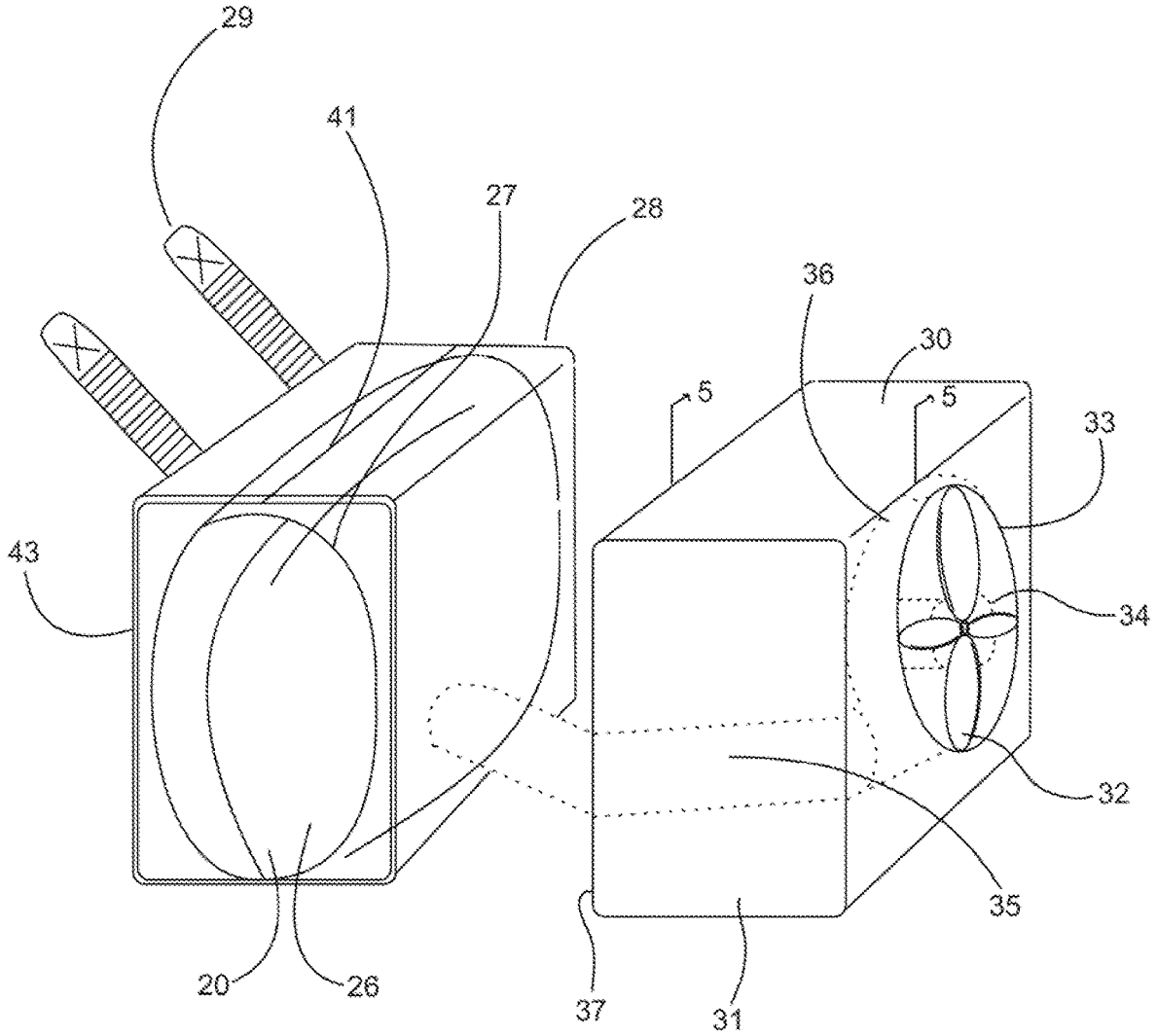
FIG. 2 is a disassembled diagram of the present invention.

As shown in FIG. 2 an inflatable structure 20 can be rolled into a stowed package 26. The stowed package 26 can fit in a storage sheath 27. The storage sheath 27 can also be strapped to retain its form. The inflatable structure 20 can then be put in a storage housing 28. The storage housing 28 can have a storage proximal portion 42 that unfolds and opens at a storage opening edge 41. The storage housing 28 thus forms a box or container that retains the inflatable structure 20. Connection straps 29 can connect to the inflatable base 21 when the device is in the deployed position in an attached mode. The connection straps 29 are preferably attached to the storage housing 28 at the storage proximal portion 43. The connection straps 29 can also close the storage housing 28 at the storage opening edge 41.

The inflation module 30 can connect to the storage housing 28 at the storage housing connector 37 formed on the inflation module 30 such that the storage housing connector 37 rigidly secures the storage housing 28 to the inflation module 30. Airflow can pass through an air inlet conduit 35. The air inlet conduit 35 receives air from an air inlet collector 36. The air inlet collector 36 is preferably acoustically treated for muffling the fan sound such as being padded or lined with a thin layer of soft foam. The inflation module 30 has an air intake 33 that receives air through a fan motor 34 powering a fan blower 32. The fan blower 32 passes air through the air inlet collector 36 and then to the inlet conduit 35. The fan blower 32 is mounted in the inflation module 30, and the storage housing 28 can also be mounted in the inflation module 30. Therefore, the entire package can be collected into a single luggage shaped container.

Figure 3:
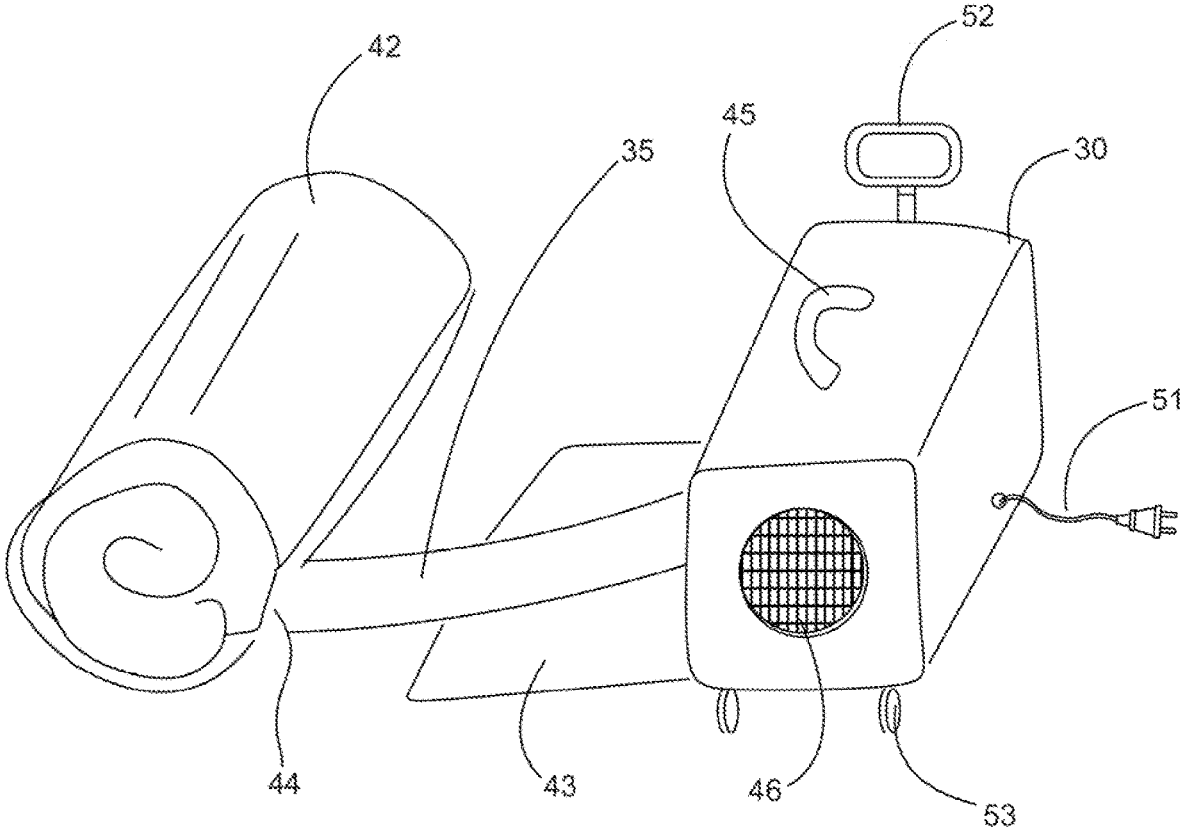
FIG. 3 is a diagram showing the roll configuration of the present invention.

As shown in FIG. 3, the inflation module 30 can have a side mounted fan blower 32 behind an air intake grill 46. The as inflation requires electricity, and the electrical cord 51 can assist in delivering power to the side mounted fan blower 32. The roll configuration 42 of the inflatable structure 20 connects to the air inlet conduit 35 at eight conduit connection 44. The storage proximal portion 43 can be formed as a flap that closes after the roll configuration 42 is rolled toward the inflation module 30. This figure does not show the storage housing 28, as the storage housing 28 is installed in the inflation module 30. Optionally, the storage housing 28 can be integrally formed with an inflation module 30 instead of as pieces that fit together such as by stitching.

The construction of the inflation module 30 with the storage proximal portion 43 is preferably as a luggage which can have hard or soft panels. The luggage configuration also preferably includes wheels 53 and pull handle 52.

Figure 4:
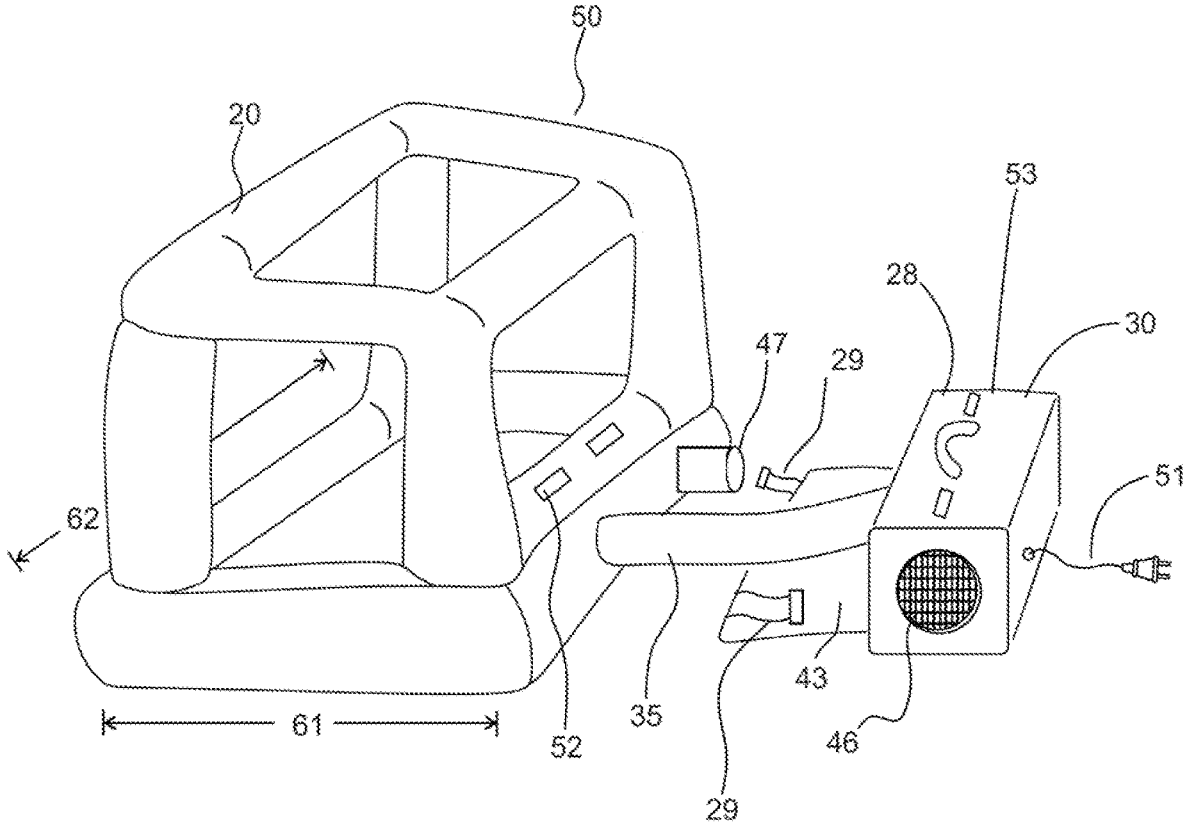
FIG. 4 is a diagram showing the extended mode of the present invention.

As shown in FIG. 4, the inflation module 30 has inflation module connection mounts 53. The straps 29 can connect to the inflation module connection mounts 53 whenever a user wants to close the flap door on the inflation module 30. The storage housing 28 is formed in the inflation module 30. The straps 29 can also connect to the inflatable structure 20. The extended mode as shown in FIG. 4 allows a user to disconnect the straps 29 from the base connection mounts 52. The air inlet conduit 35 extends long enough so that the inflation module 30 can be placed away from the inflatable structure. Here, the inflatable structure is a partially inflated structure 50 that is in the process of being inflated. The partially inflated structure 50 has an air outlet 47 four deflating the partially inflated structure 50. The inflatable structure additionally has an inflatable structure length 61 and an inflatable structure width 62. The length and width dimensions define a footprint that is larger than the inflation module 30. After use in the extended mode as seen in FIG. 4, the device can also be reconfigured to an attached mode as seen in FIG. 1. The device can be switched between the extended mode where the inflation module 30 is away from the inflatable jumper, and the attached mode where the inflation module 30 and the storage housing 28 are attached to the inflatable structure. The inflation module 30 can be folded for a smaller profile when attached, and unfolded for a larger profile when detached.

Figure 5:
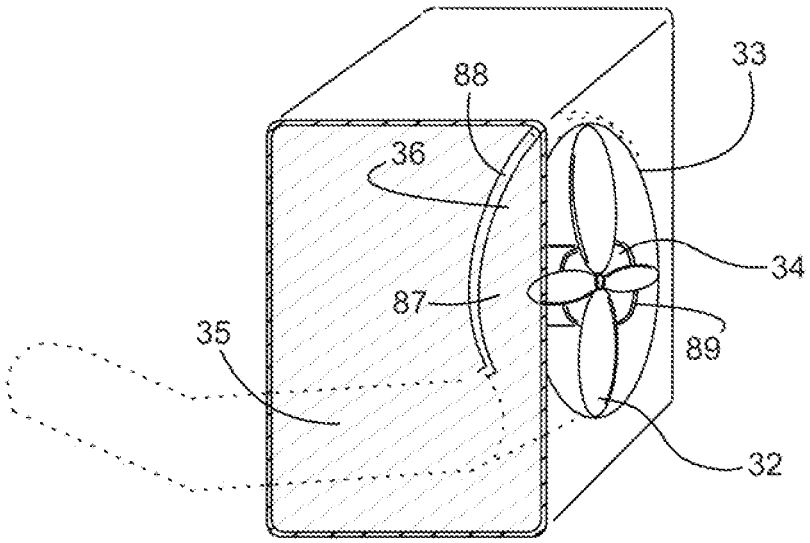
FIG. 5 is a cross section view of the present invention showing the sound attenuation cover for the fan.

As shown in FIG. 5, the air inlet collector 36 preferably includes an air inlet collector cover 88 that is mounted to the air inlet collector 36 and muffles the sound. The air inlet collector cover 88 can be a mineral wool sheet that is formed over the air inlet collector 36. The air inlet collector 36 has a concave shape and thus the air inlet collector cover 88 also has a concave shape to conform to the shape of the air inlet collector 36. The air inlet collector cover 88 provides additional sound attenuation for users that are playing on the play structure. The air inlet collector 36 may have a sound reflecting surface such as a hard plastic surface that directs sound away from the device. Additionally, the motor 34 may have a motor cover 89. The motor cover 89 can be made of a sound attenuation structure such as high density mineral wool. If made of mineral wool, preferably at least an exterior surface of the mineral is treated with a binder such as epoxy to avoid dislocation of stray strands of mineral wool. The air inlet collector 37 preferably has a concave shape that provides an air inlet collector concave cavity 87 which directs sound and attenuates sound.

The invention claimed is:

1. An inflatable structure with integrated carrier comprising:

an inflatable structure, wherein the inflatable structure has an inflated mode and a deflated mode, wherein the inflatable structure has an inflatable base;

an inflation module connected to the inflatable structure, wherein the inflation module comprises an inflation module housing, wherein the inflation module has a fan blower powered by a fan motor mounted within the inflation module housing, wherein the inflation module further includes an air intake, wherein the fan blower draws air from the air intake and inflates the inflatable structure, wherein the inflation module further comprises wheels and a pull handle attached to the inflation module housing; and a storage housing, wherein the storage housing is formed within the inflation module housing of the inflation module, wherein the storage housing receives the inflatable structure when the inflatable structure is in a deflated mode, whereby the inflation module housing, the storage housing, the wheels, and the pull handle together define a single luggage configuration that transports the inflatable structure when the inflatable structure is in the deflated mode.

2. The inflatable structure with integrated carrier of claim 1, wherein the fan blower is mounted at the air intake.

3. The inflatable structure with integrated carrier of claim 1, further including connection straps, wherein the connection straps are mounted on the inflation module and are configured to directly connect the inflation module to the inflatable base of the inflatable structure when the inflatable structure is in the inflated mode.

4. The inflatable structure with integrated carrier of claim 1, further including connection straps, wherein the connection straps are mounted on the storage housing and wherein the connection straps are configured to close the storage housing and retain the inflatable structure within the storage housing.

5. The inflatable structure with integrated carrier of claim 1, further including an attached mode, wherein the inflation module attaches to the inflatable structure at the inflatable base, after the inflatable structure is removed from the inflation module.

6. The inflatable structure with integrated carrier of claim 1, wherein the inflation module has an attached mode, wherein the inflation module attaches to the inflatable structure at the inflatable base in the attached mode.

7. The inflatable structure with integrated carrier of claim 1, further including an air inlet conduit extending between the inflation module and the inflatable structure, wherein the fan blower is configured to inflate the air inlet conduit, wherein the air inlet conduit is inflatable, and wherein the inflation module is selectively reconfigurable between (i) an attached mode in which the inflation module is attached to the inflatable base and (ii) an extended mode in which the inflation module is positioned away from the inflatable structure and is connected to the inflatable structure only through the air inlet conduit.

8. The inflatable structure with integrated carrier of claim 7, wherein the inflation module has a detached mode, wherein the inflation module detaches from the inflatable structure, only being connected at a conduit.

9. The inflatable structure with integrated carrier of claim 7, wherein the fan blower is mounted at the air intake.

10. The inflatable structure with integrated carrier of claim 7, further including connection straps, wherein the connection straps are mounted on the storage housing and are configured to connect the storage housing to the inflatable base.

11. The inflatable structure with integrated carrier of claim 7, further including connection straps, wherein the connection straps are mounted on the storage housing and wherein the connection straps are configured to close the storage housing and retain the inflatable structure within the storage housing in the deflated mode.

12. The inflatable structure with integrated carrier of claim 7, further including an attached mode, wherein the inflation module attaches to the inflatable structure at the inflatable base.

13. The inflatable structure with integrated carrier of claim 7, wherein the inflation module has an attached mode, wherein the inflation module attaches to the inflatable structure at the inflatable base in the attached mode.

14. An inflatable structure with integrated carrier comprising:

an inflatable structure, wherein the inflatable structure has an inflated mode and a deflated mode, wherein the inflatable structure has an inflatable base;

an inflation module connected to the inflatable structure, wherein the inflation module comprises an inflation module housing, wherein the inflation module has a fan blower powered by a fan motor mounted within the inflation module housing, wherein the inflation module further includes an air intake, wherein the fan blower draws air from the air intake and inflates the inflatable structure, wherein the inflation module further comprises wheels and a pull handle attached to the inflation module housing;

a storage housing, wherein the storage housing is formed within the inflation module housing of the inflation module, wherein the storage housing receives the inflatable structure when the inflatable structure is in a deflated mode; and an air collector, wherein the air collector is formed around the fan blower, wherein the air collector is configured to muffle the sound of the fan motor, wherein a sound attenuation cover is mounted to the air collector, wherein the air collector has a concave shape defining a concave cavity that receives the fan motor, and wherein the sound attenuation cover comprises a mineral wool sheet conformed to the concave shape of the air collector.

15. The inflatable structure with integrated carrier of claim 14, wherein the fan blower is mounted at the air intake.

16. The inflatable structure with integrated carrier of claim 14, further including connection straps, wherein the connection straps are mounted on the storage housing and are configured to connect the storage housing to the inflatable base.

17. The inflatable structure with integrated carrier of claim 14, further including connection straps, wherein the connection straps are mounted on the storage housing and wherein the connection straps are configured to close the storage housing and retain the inflatable structure within the storage housing.

18. The inflatable structure with integrated carrier of claim 14, further including an attached mode, wherein the inflation module attaches to the inflatable structure at the inflatable base, after the inflatable structure is removed from the inflation module.

19. The inflatable structure with integrated carrier of claim 14, wherein the inflation module has an attached mode, wherein the inflation module attaches to the inflatable structure at the inflatable base in the attached mode.

20. The inflatable structure with integrated carrier of claim 14, further including an air inlet conduit, wherein the fan blower is configured to inflate the air inlet conduit, wherein the air inlet conduit is inflatable.

* * * * *